US006373445B1

(12) United States Patent
Kuno

(10) Patent No.: US 6,373,445 B1
(45) Date of Patent: Apr. 16, 2002

(54) CONVERTER FOR ANTENNA TO RECEIVE SIGNALS FROM TWO SATELLITES

(75) Inventor: Takehito Kuno, Nisshin (JP)

(73) Assignee: Masprodenkoh Kabushikikaisha, Nisshin (JP)

( * ) Notice: Subject to any disclaimer, the term of this patent is extended or adjusted under 35 U.S.C. 154(b) by 0 days.

(21) Appl. No.: 09/605,767

(22) Filed: Jun. 28, 2000

(30) Foreign Application Priority Data

Jun. 30, 1999 (JP) ..... 11-185591

(51) Int. Cl.[7] ..... H01Q 13/00
(52) U.S. Cl. ..... 343/786; 343/781 R
(58) Field of Search ..... 343/756, 786, 343/781 R, 776, 775, 779, 878, 884; 455/318, 12.1, 3.2; 333/21 R

(56) References Cited

U.S. PATENT DOCUMENTS 5,805,975 A * 9/1998 Green, Sr. et al. ..... 455/3.2
6,111,547 A * 8/2000 Gau et al. ..... 343/785

* cited by examiner

*Primary Examiner*—Don Wong
*Assistant Examiner*—James Clinger
(74) *Attorney, Agent, or Firm*—Davis & Bujold, PLLC

(57) ABSTRACT

A converter is provided for changing frequencies of received signals generated by a single receiving antenna, when it receives radio waves transmitted from two artificial satellites (i.e., BS and CS) located in the same direction seen from a receiving point, to convert the received signals into received signals for transmission, wherein the received signals after such frequency changes can simultaneously be transmitted to a terminal side by way of a single transmission line.

A radio wave of a right-hand circularly polarized wave transmitted from a broadcasting satellite (BS) as well as a radio wave of a right-hand circularly polarized wave and a radio wave of a left-hand circularly polarized wave both transmitted from a communication satellite (CS) are all received by a single receiving antenna, and each of received signals resulting from those radio waves is converted into a received signal for transmission by a converter. The converter comprises two frequency changing portions: one is for changing frequencies of the received signals of the right-hand circularly polarized waves, and the other is for changing a frequency of the received signal of the left-hand circularly polarized wave. In addition, an oscillator for frequency changes is provided in each of the frequency changing portions. An oscillation frequency of each oscillator is set such that the received signal of the left-hand circularly polarized wave, i.e., the CS (L) signal, has a frequency higher than those of the received signals of the right-hand circularly polarized waves, i.e., the BS signal and the CS (R) signal, and a harmonic of a signal component f1 of a difference between the oscillation frequencies of the two oscillators does not overlap a frequency band of each of the received signals.

11 Claims, 3 Drawing Sheets

CONVERTER FOR ANTENNA TO RECEIVE SIGNALS FROM TWO SATELLITES

FIELD OF THE INVENTION

This invention relates to a converter for an antenna to receive signals from two satellites, which is preferable for conversion of received signals generated by a receiving antenna into received signals for transmission, when the receiving antenna receives radio waves transmitted from two artificial satellites being located in the same direction seen from a receiving point.

BACKGROUND OF THE INVENTION

Heretofore, a broadcasting satellite (so-called BS) and a communication satellite (so-called CS), both of which transmit radio waves that can be received in Japan, have been located in different directions seen from a receiving point. Also, a system of each satellite for transmission of radio waves is different from each other. More specifically, radio waves transmitted from the broadcasting satellite are right-hand circularly polarized waves, while radio waves transmitted from the communication satellite are two orthogonal polarized waves each consisting of a vertically polarized wave and a horizontally polarized wave. Consequently, such radio waves transmitted from either of the artificial satellites (i.e., BS or CS) have been received by the respective receiving antennas constituted independently of each other.

In the near future, however, a new communication satellite (specifically, NSAT-N-SAT110, produced by Nippon Satellite Systems, Co., Ltd. and Space Communication, Co., Ltd.) is going to be launched to be located in the same direction as the broadcasting satellite, seen from the receiving point in Japan, more specifically, at 110 degrees of east longitude. In addition, it has been decided that two types of circularly polarized waves, that is, right-hand and left-hand circularly polarized waves, should be adopted as radio waves to be transmitted from the new communication satellite.

Under such circumstances, it will become possible to receive radio waves transmitted from the broadcasting satellite as well as those transmitted from the foregoing communication satellite to be newly launched by a single receiving antenna, by improving a receiving antenna in conventional use for reception of radio waves transmitted from the broadcasting satellite.

A radio wave transmitted from the foregoing new communication satellite has a frequency higher than that of a radio wave transmitted from the broadcasting satellite, and therefore, the frequencies of received signals from the two satellites do not overlap each other. However, a radio wave of a right-hand circularly polarized wave and a radio wave of a left-hand circularly polarized wave, both transmitted from the foregoing new communication satellite, should be in the same frequency band to effectively utilize the assigned frequencies, in the same manner as the other communication satellite.

For this reason, in the event that, as mentioned above, radio waves transmitted from the two artificial satellites (i.e., BS and CS), being located in the same direction seen from the receiving point, are received by a single receiving antenna, and then, received signals generated by the receiving antenna are converted into received signals for transmission having frequencies lower than those of the transmitted radio waves using a common converter (or frequency changer), it is necessary to switch the received signal(s) to be inputted to the converter from/to a BS received signal of a right-hand circularly polarized wave as well as a CS received signal of a right-hand circularly polarized wave (hereinafter, also referred to as a CS (R) signal) to/from a CS received signal of a left-hand circularly polarized wave (hereinafter, also referred to as a CS (L) signal) according to necessity.

With such structure, however, in cases where the received signals are transmitted to a plurality of receiving terminals, for example, in a home community receiving system, a desired broadcast can not be received at each of the plurality of receiving terminals.

In view of the above problem, this invention has been developed. An object of the invention is to provide a converter for changing frequencies of received signals generated by a single receiving antenna, when it receives radio waves transmitted from two artificial satellites (i.e., BS and CS) located in the same direction seen from a receiving point, to convert the received signals into received signals for transmission, the converter being capable of simultaneously transmitting the received signals after frequency changes to a terminal side by way of a single transmission line.

SUMMARY OF THE INVENTION

In order to attain this object, the invention as recited in claim 1 provides a converter for an antenna to receive signals from two satellites, which is provided in a receiving antenna capable of receiving: (1) a radio wave of a right-hand circularly polarized wave within a first frequency band, transmitted from a first artificial satellite;

(2) a radio wave of a right-hand circularly polarized wave within a second frequency band in which frequencies are higher than those of the first frequency band, transmitted from a second artificial satellite; and (3) a radio wave of a left-hand circularly polarized wave within the second frequency band, transmitted from the second artificial satellite, the first and second artificial satellites being located in the same direction seen from a receiving point, the converter being capable of converting a received signal resulting from each of the radio waves received by the receiving antenna into a received signal within a predetermined transmission frequency band, having a frequency lower than that of the respective radio wave and being able to be simultaneously transmitted, together with received signals resulting from the other radio waves, via a single transmission line. The converter according to the invention operates as follows:

A right-hand frequency changing portion changes frequencies of the received signals of the right-hand circularly polarized waves within the first and second frequency bands to convert them into received signals within the respectively predetermined transmission frequency bands, using first oscillating signals generated by a first oscillator. On the other hand, a left-hand frequency changing portion changes a frequency of the received signal of the left-hand circularly polarized wave within the second frequency band to convert it into a received signal within a transmission frequency band in which frequencies are higher than those of the received signals outputted from the right-hand frequency changing portion, using a second oscillating signal generated by a second oscillator having an oscillation frequency lower than that of the first oscillator. Subsequently, the received signals from the right-hand frequency changing portion are transmitted to a received signals output portion, via a first filtering portion for cutting off at least signal components in the same frequency band as the received signal outputted from the left-hand frequency changing portion falls within. The received signal from the left-hand frequency changing portion is transmitted to the received signals output portion, via a second filtering portion for cutting off at least signal components in the same frequency bands as the received signals outputted from the right-hand frequency changing portion fall within. The received signals transmitted from the right-hand and left-hand frequency changing portions are mixed at the received signals output portion, and then outputted from a common output-terminal.

Consequently, by use of a converter for an antenna to receive signals from two satellites according to the present invention, received signals from a receiving antenna for receiving the aforementioned radio waves (1) to (3) can be converted into received signals for transmission which can simultaneously be transmitted to a terminal side via a single transmission line. The converter is therefore preferable for transmission to a plurality of receiving terminals of received signals from the aforementioned two artificial satellites, for example, in a home community receiving system.

Now, the oscillation frequency of the second oscillator may be set such that, by a frequency-changing operation of the left-hand frequency changing portion, the frequency of the received signal outputted from the left-hand frequency changing portion becomes higher than those of the received signals outputted from the right-hand frequency changing portion. However, if the oscillation frequency of the second oscillator is set to be too low, a transmission frequency of the received signal outputted from the left-hand frequency changing portion becomes high. As a result, a transmission loss in transmission of the received signal to the terminal side becomes great. In addition, there is a possibility that transmission equipment, such as a transmission line for received signals and a booster provided on such a transmission line, having conventional frequency characteristics can not be applied.

For the above reasons, the oscillation frequency of the second oscillator is desirably set such that a difference between the lowest frequency of the received signal outputted from the left-hand frequency changing portion and the highest frequency of the received signals outputted from the right-hand frequency changing portion is as small as possible in the range that the difference is equal to or over a frequency (for example, 50 MHz) with which the received signals outputted from the right-hand and left-hand frequency changing portions can be separated from each other by the first and second filtering portions. More specifically, as recited in claim 2, the oscillation frequency of the second oscillator should be set such that, by operation of the left-hand frequency changing portion, a signal component within the first frequency band becomes a signal component within a transmission frequency band overlapping those of the received signals outputted from the right-hand frequency changing portion.

Also, according to the present invention, the radio wave of the right-hand circularly polarized wave and the radio wave of the left-hand circularly polarized wave, both received by the receiving antenna, are respectively changed in frequencies by means of two oscillators, that is, the first and second oscillators. Consequently, a possibility arises that a harmonic component of a difference between the oscillation frequencies of those oscillators might be overlapped with the received signals.

For the above reason, as recited in claim 3, it is desirable that the oscillation frequencies of the first and second oscillators should be set such that the harmonic component of the difference between the oscillation frequency of the first oscillator and that of the second oscillator never overlaps any of the transmission frequency bands of the received signals outputted from the right-hand and left-hand frequency changing portions.

BRIEF DESCRIPTION OF THE DRAWINGS

An embodiment of the invention is now described with reference to the accompanying drawings.

DETAILED DESCRIPTION OF THE INVENTION

Figure 1:
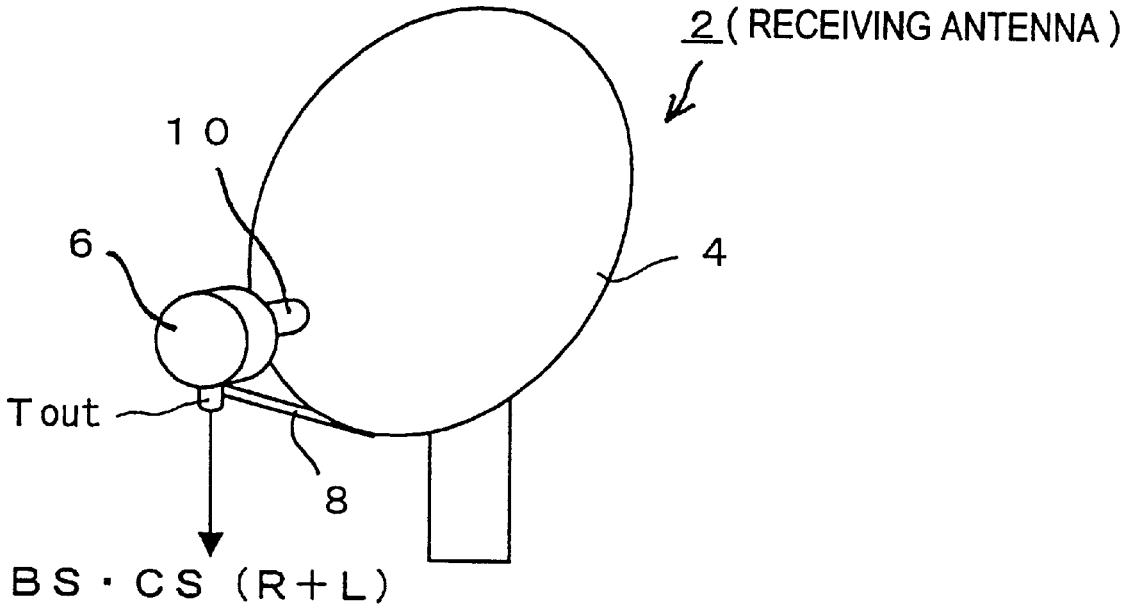
FIG. 1 is a schematic diagram showing a constitution of a receiving antenna according to an embodiment.
Figure 2:
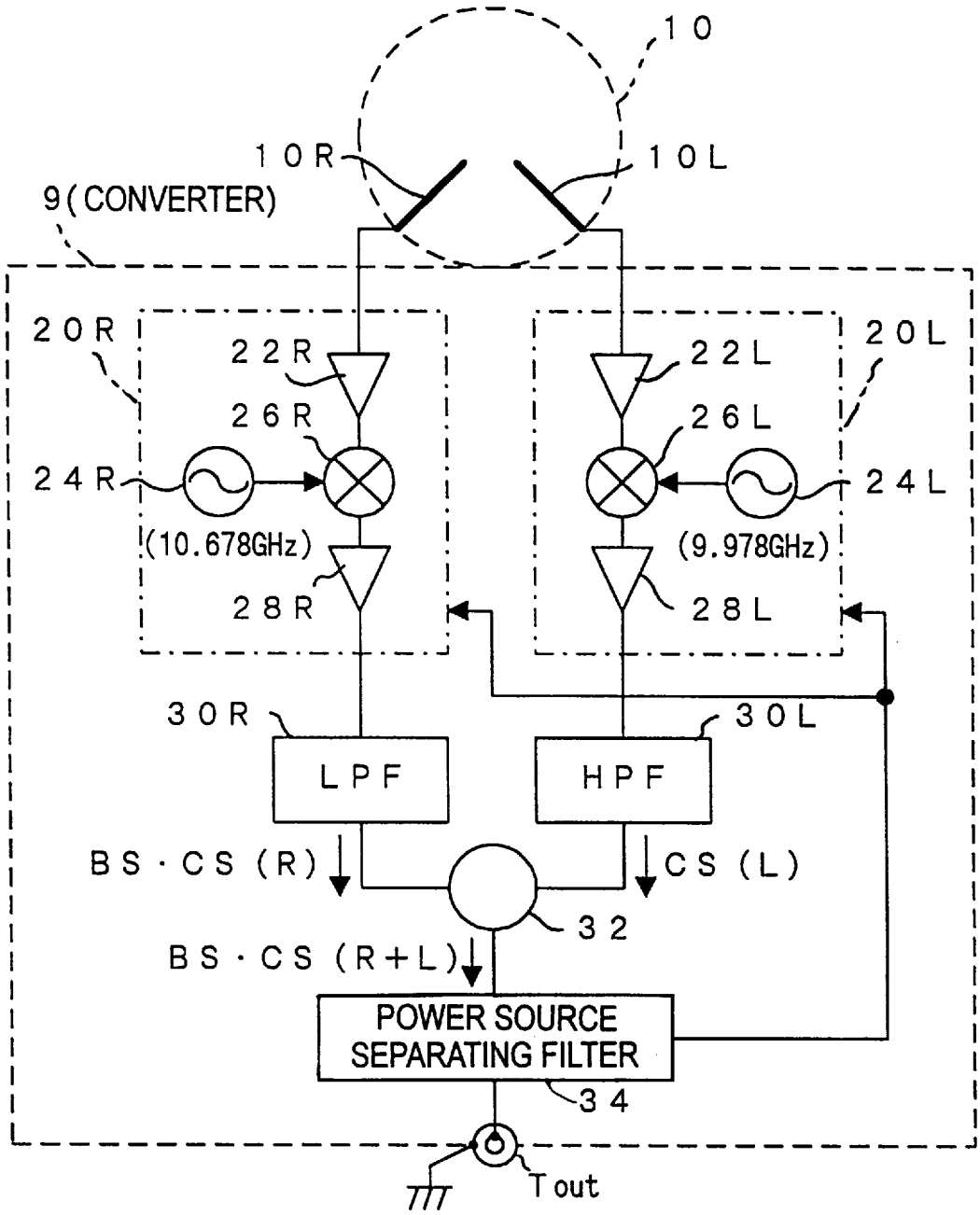
FIG. 2 is an electric circuit diagram showing a constitution of a converter embedded in a receiving portion of the receiving antenna according to the embodiment.

FIG. 1 is a schematic diagram showing a constitution of a receiving antenna 2 according to an embodiment to which the invention is applied. FIG. 2 is an electric circuit diagram showing a constitution of a converter 9 embedded in a receiving portion 6 of the receiving antenna 2.

The receiving antenna 2 in the embodiment is a parabolic antenna for receiving radio waves (1) to (3) given below (see FIG. 3(*a*)), which are transmitted from two artificial satellites located in the same direction seen from a receiving point in Japan.

A radio wave (1) is a right-hand circularly polarized wave within a first frequency band (specifically, between 11.713 GHz and 12.013 GHz) transmitted from a broadcasting satellite (BS), as a first artificial satellite, which has already been launched to be located over the equator at 110 degrees of east longitude.

A radio wave (2) is a right-hand circularly polarized wave within a second frequency band (specifically, between 12.271 GHz and 12.751 GHz) transmitted from a communication satellite (CS), as a second artificial satellite, which is to be launched to be located approximately at the same location as the broadcasting satellite (BS) (that is, over the equator at 110 degrees of east longitude).

A radio wave (3) is a left-hand circularly polarized wave within the second frequency band (specifically, between 12.251 GHz and 12.731 GHz) transmitted from the communication satellite (CS) mentioned above.

The receiving antenna 2 is composed of a reflector 4 and a receiving portion Furthermore, the receiving portion 6 has a converter 9 embedded therein, which is constituted as illustrated in FIG. 2.

The converter 9 takes in received signals of both of right-hand and left-hand circularly polarized waves by way of a circular polarization-linear polarization converter (not shown) formed in a waveguide 10 protruding toward the reflector 4 in the receiving portion 6, as well as by way of probes 10R and 10L for receiving radio waves corresponding to right-hand and left-hand circularly polarized waves, respectively, which have been converted into linearly polarized waves by the circular polarization-linear polarization converter. The converter 9 then changes frequencies of those received signals to convert them into received signals for transmission within the respectively predetermined frequency bands, which can be transmitted from an output-terminal Tout to a receiving terminal via a single coaxial cable as a transmission line. Also, the converter 9 is integrated with the receiving antenna 2 by having its components (electric circuits), as described below, assembled on a wiring substrate, which is accommodated in a waterproof housing of the receiving portion 6.

As shown in FIG. 2, the converter 9 comprises a right-hand frequency changing portion 20R and a left-hand frequency changing portion 20L for changing the frequencies of the received signals from the probes 10R and 10L, respectively.

The right-hand frequency changing portion 20R includes an amplifying circuit 22R for amplifying a received signal outputted from the probe 10R for receiving a right-hand circularly polarized wave, a first oscillator 24R for generating a first oscillating signal (in the embodiment, a signal having a frequency of 10.678 GHz equal to a frequency of a signal received by a BS antenna in general use) for a frequency change of the received signal, a mixer 26R for mixing the first oscillating signal from the first oscillator 24R with the received signal amplified by the amplifying circuit 22R to change the frequency of the received signal of the right-hand circularly polarized wave, and an amplifying circuit 28R for further amplifying the received signal the frequency of which has been changed by the mixer 26R.

The left-hand frequency changing portion 20L includes an amplifying circuit 22L for amplifying a received signal outputted from the probe 10L for receiving a left-hand circularly polarized wave, a second oscillator 24L for generating a second oscillating signal, having a frequency lower than that of the first oscillating signal (in the embodiment, for example, a signal having a frequency of 9.978 GHz), for a frequency change of the received signal, a mixer 26L for mixing the second oscillating signal from the second oscillator 24L with the received signal amplified by the amplifying circuit 22L to change the frequency of the received signal of the left-hand circularly polarized wave, and an amplifying circuit 28L for further amplifying the received signal the frequency of which has been changed by the mixer 26L.

Figure 3:
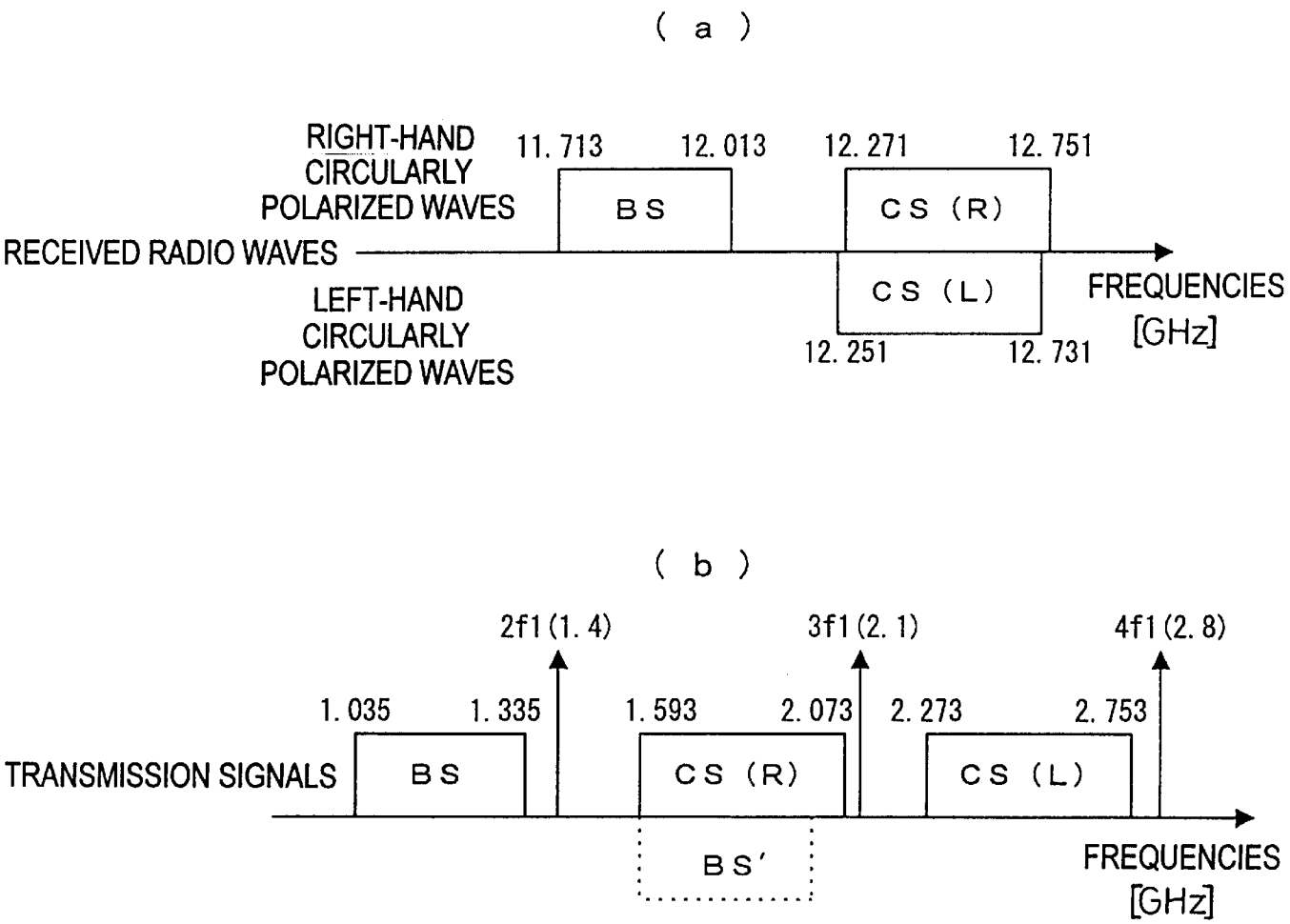
FIG. 3 is an explanatory views showing frequency characteristics of radio waves which can be received from two satellites by the receiving antenna according to the embodiment and those of received signals after frequency changes by the converter.

Because of the foregoing structure, as shown in FIG. 3(*b*), a received signal of a right-hand circularly polarized wave transmitted from the broadcasting satellite (BS), that is, a BS signal having a frequency between 11.713 GHz and 12.013 GHz, as mentioned above, is converted into a received signal for transmission having a frequency between 1.035 GHz and 1.335 GHz in the right-hand frequency changing portion 20R. Also, a received signal of a right-hand circularly polarized wave transmitted from the communication satellite (CS), that is, a CS (R) signal having a frequency between 12.271 GHz and 12.751 GHz, as mentioned above, is converted into a received signal for transmission having a frequency between 1.593 GHz and 2.073 GHz in the right-hand frequency changing portion 20R. Furthermore, a received signal of a left-hand circularly polarized wave transmitted from the communication satellite (CS), that is, a CS (L) signal having a frequency between 12.251 GHz and 12.731 GHz, as mentioned above, is converted into a received signal for transmission having a frequency between 2.273 GHz and 2.753 GHz in the left-hand frequency changing portion 20L.

After frequency changes in the right-hand frequency changing portion 20R, the received signals of the right-hand circularly polarized waves are outputted toward the output-terminal Tout by way of a low-pass filter (LPF) 30R, as a first filtering portion, having a cut-off frequency of 2.073 GHz. After a frequency change in the left-hand frequency changing portion 20L, the received signal of the left-hand circularly polarized wave is outputted toward the output-terminal Tout by way of a high-pass filter (HPF) 30L, as a second filtering portion, having a cut-off frequency of 2.273 GHz. After passing through the filter 30R or 30L, the received signals, namely, the BS signal, the CS (R) signal, and the CS (L) signal, are all mixed by a mixing device 32 and, then, transmitted to the output-terminal Tout.

Also, a power source separating filter 34 for separating dc voltage for feeding (for example, DC 15V), which has been transmitted from a terminal side to the output-terminal Tout via a coaxial cable for transmission of received signals, is provided on a transmission path for the received signals connecting the mixing device 32 and the output-terminal Tout. Each of the aforementioned frequency changing portions 20R and 20L operates on the dc voltage separated by the power source separating filter 34.

In the embodiment, as mentioned above, the converter 9 is provided in the receiving antenna 2 capable of receiving, via the probes 10R and 10L, radio waves transmitted from the broadcasting satellite (BS) and the communication satellite (CS), both of which are to be located in the same direction seen from the receiving point. The converter 9 converts a received signal of a right-hand circularly polarized wave received by the prove 10R (i.e., a BS or CS (R) signal) and a received signal of a left-hand circularly polarized wave received by the probe 10L (i.e., a CS (L) signal) into received signals for transmission each having a frequency in the different frequency bands. Furthermore, in the converter 9, each of the received signals after such conversion is passed through the low-pass filter 30R or the high-pass filter 30L, each capable of cutting off the other received signal, and subsequently, the received signals are mixed with each other by the mixing device 32, as a received signals output portion, to be outputted from the output-terminal Tout.

By using the converter 9 according to the embodiment, it becomes possible to simultaneously transmit, via the coaxial cable connected with the output-terminal Tout, to the terminal side the received signals of the radio waves transmitted from both of the aforementioned satellites (i.e., BS and CS). Such a converter is preferable for transmission of the received signals from the aforementioned two satellites (i.e., BS and CS) to a plurality of receiving terminals, for example, in a home community receiving system.

Now, in this embodiment, an oscillation frequency of the first oscillator 24R is set to be 10.678 GHz for the purpose of converting the received signal from the broadcasting satellite (BS), that is, the BS signal, into a signal having a frequency equal to that of a received signal from a conventional BS antenna. As a result, receiving apparatus for BS broadcasting, such as a tuner, TV set or video tape recorder, in conventional use can be employed as it is at a terminal side.

On the other hand, an oscillation frequency of the second oscillator 24L (i.e., 9.978 GHz) is set to be lower than that of the first oscillator 24R (i.e., 10.678 GHz) for the purpose of converting the received signal of the left-hand circularly polarized wave from the communication satellite (CS), received by the probe 10L, into a signal within a frequency band in which frequencies are higher than those of the received signals outputted from the right-hand frequency changing portion 20R.

Also, in this embodiment, the oscillation frequency of the second oscillator 24L is set to be 9.978 GHz with the results that: (i) a signal component in the first frequency band (i.e., between 11.713 GHz and 12.013 GHz), equal to the frequency band of the radio waves transmitted from the broadcasting satellite (BS), is converted into a signal component, as shown by a dotted line and named BS' signal in FIG. 3(*b*), in a transmission frequency band overlapping the frequency band of the received signal outputted from the right-hand frequency changing portion 20R, more specifically, the CS (R) signal, by operation of the left-hand frequency changing portion 20L, and consequently, a difference between the frequency of the received signal outputted from the right-hand frequency changing portion 20R and the frequency of the received signal outputted from the left-hand frequency changing portion 20L becomes small; and (ii) harmonic signal components (that is, a second harmonic 2*f*1=1.4 GHz, a third harmonic 3*f*1=2.1 GHz, and a fourth harmonic 4*f*1=2.8 GHz) of a signal component having a frequency equal to a difference between the frequency of the oscillating signal from the first oscillator 24R and the frequency of the oscillating signal from the second oscillator 24L (that is, in the embodiment, a signal component having a frequency f1=0.7 GHz) do not overlap the received signals from either satellite (BS or CS), as shown in FIG. 3(*b*).

Specifically, even in cases where the difference between the frequency of the received signal outputted from the left-hand frequency changing portion 20L and the frequency of the received signal outputted from the right-hand frequency changing portion 20R is great, it is possible to transmit those received signals at the same time. In such a case, however, the frequency of the received signal outputted from the left-hand frequency changing portion 20L, i.e., the CS (L) signal, becomes high, and a transmission loss in transmission of the CS (L) signal to the terminal side becomes great. As a result, the CS (L) signal can not be transmitted to the terminal side using an existing coaxial cable.

Also, by determining the oscillation frequency of the second oscillator 24L without much consideration, the harmonics of the signal component generated by the difference between the oscillation frequency of the second oscillator 24L and that of the first oscillator 24R may be overlapped with any of the received signals (i.e., the BS signal, the CS (R) signal and the CS (L) signal) outputted from the converter, which results in an inferior transmission of the received signals.

In order to avoid these problems, in this embodiment, the oscillation frequency of the second oscillator 24L is determined to be 9.978 GHz.

However, in order to prevent such problems from arising, the oscillation frequency of the second oscillator 24L does not necessarily need to be 9.978 GHz, and can be in the range of 9.892 GHz and 9.986 GHz.

What is claimed is:

1. A converter for an antenna to facilitate receiving signals from two satellites, the converter being provided with a receiving antenna capable of receiving:

a right-hand circularly polarized radio wave within a first frequency band to be transmitted from a first artificial satellite;

a right-hand circularly polarized radio wave within a second frequency band to be transmitted from a second artificial satellite, with frequencies of the second frequency band being higher than frequencies of the first frequency band; and a left-hand circularly polarized radio wave within the second frequency band to be transmitted from the second artificial satellite, the first and second artificial satellites being located so as to be received by the receiving antenna when the receiving antenna is aimed is a single receiving direction, and the converter being capable of converting received signals, from each of the received radio waves, into a received signal within a predetermined transmission frequency band having a frequency lower than the frequencies of the respective radio wave and being able to be simultaneously transmitted, together with received signals resulting from other radio waves, via a single transmission line;

the converter comprising:

a right-hand frequency changing portion, including a first oscillator for generating first oscillating signals, for changing frequencies of the received signals of the right-hand circularly polarized radio waves within the first and second frequency bands to convert the received right-hand circularly polarized radio waves, via use of the first oscillating signals, into received signals within the respectively predetermined transmission frequency bands;

a left-hand frequency changing portion, including a second oscillator for generating second oscillating signal having an oscillation frequency lower than the first oscillating signals, for changing a frequency of the received signal of the left-hand circularly polarized radio wave within the second frequency band to convert the received left-hand circularly polarized radio wave, via use of the second oscillating signal, into a received signal within a transmission frequency band with frequencies higher than the frequencies of the received signals outputted from the right-hand frequency changing portion;

a first filtering portion, provided along an output path for the received signals from the right-hand frequency changing portion, for passing the received signals from the right-hand frequency changing portion and for eliminating at least signal components within a frequency band similar to the received signal outputted from the left-hand frequency changing portion;

a second filtering portion, provided along an output path for the received signal from the left-hand frequency changing portion, for passing of the received signal from the left-hand frequency changing portion and for eliminating at least signal components within frequency bands similar the received signals outputted from the right-hand frequency changing portion; and a received signals output portion for mixing the received signals from the right-hand frequency changing portion, passed through the first filtering portion, and the received signal from the left-hand frequency changing portion, passed through the second filtering portion, to thereby output the received signals at a common output-terminal.

2. The converter for an antenna for receiving signals from two satellites according to claim 1, wherein the oscillation frequency of the second oscillator is set such that, by operation of the left-hand frequency changing portion, a signal component within the first frequency band becomes a signal component within a transmission frequency band overlapping those of the received signals outputted from the right-hand frequency changing portion.

3. The converter for an antenna for receiving signals from two satellites according to claim 1, wherein the oscillation frequencies of the first and second oscillators are set such that a harmonic component of a difference between the oscillation frequency of the first oscillator and the oscillation frequency of the second oscillator never overlaps any of the transmission frequency bands of the received signals outputted from the right-hand and left-hand frequency changing portions.

4. The converter for an antenna for receiving signals from two satellites according to claim 1, wherein the antenna further comprises a reflector for reflecting received signals from the first and second artificial satellites toward a signal receiving portion located at a focal point of the reflector, and the signal receiving portion being supported at the focal point of the reflector via a supporting arm.

5. The converter for an antenna for receiving signals from two satellites according to claim 1, wherein the right-hand frequency changing portion comprises:

a first right-hand frequency amplifying circuit for amplifying a received right-hand frequency signal;

a right-hand frequency mixer electrically connected to the first right-hand frequency amplifying circuit and to the first oscillator for mixing the first oscillating signal with the signal received from the first right-hand frequency amplifying circuit;

a second right-hand frequency amplifying circuit for receiving the signal mixed by the right-hand frequency mixer and for supplying an amplified signal to the first filtering portion; and the left-hand frequency changing portion comprises:

a first left-hand frequency amplifying circuit for amplifying a received left-hand frequency signal;

a left-hand frequency mixer electrically connected to the first left-hand frequency amplifying circuit and to the second oscillator for mixing the second oscillating signal with the signal received from the first left-hand frequency amplifying circuit;

a second left-hand frequency amplifying circuit for receiving the signal mixed by the left frequency mixer and for supplying an amplified signal to the second filtering portion.

6. The converter for an antenna for receiving signals from two satellites according to claim 1, wherein the converter further comprises a combined mixing device for mixing a signal received from the first filtering portion with a signal received from the second filtering portion and outputting the combined mixed signal to a power source separating filter, and the power source separating filter is electrically connected to the common output-terminal.

7. The converter for an antenna for receiving signals from two satellites according to claim 1, wherein the first frequency band is between 11.713 and 12.013 GHz; and the second frequency band is between 12.271 and 12.751 GHz.

8. A converter for an antenna to receive signals from two satellites, which is provided in a receiving antenna capable of receiving:

a right-hand circularly polarized radio wave within a first frequency band, transmitted from a first artificial satellite;

a right-hand circularly polarized radio wave within a second frequency band in which frequencies are higher than those of the first frequency band, transmitted from a second artificial satellite; and a left-hand circularly polarized radio wave within the second frequency band, transmitted from the second artificial satellite, the first and second artificial satellites being located in substantially the same direction as seen from a receiving point, the converter being capable of converting a received signal resulting from each of the radio waves received by the receiving antenna into a received signal within a predetermined transmission frequency band, having a frequency lower than that of the respective radio wave and being able to be simultaneously transmitted, together with received signals resulting from other radio waves, via a single transmission line, the converter comprising:

a right-hand frequency changing portion for changing frequencies of the received signals of the right-hand circularly polarized radio waves within the first and second frequency bands to convert them into received signals within the respectively predetermined transmission frequency bands, using first oscillating signals generated by a first oscillator;

a left-hand frequency changing portion for changing a frequency of the received signal of the left-hand circularly polarized radio wave within the second frequency band to convert it into a received signal within a transmission frequency band in which frequencies are higher than those of the received signals outputted from the right-hand frequency changing portion, using a second oscillating signal generated by a second oscillator having an oscillation frequency lower than that of the first oscillator;

a first filtering portion provided on an output path for the received signals from the right-hand frequency changing portion, for passing of the received signals from the right-hand frequency changing portion as well as for eliminating at least signal components within a frequency band higher than the received signals from the right-hand frequency changing portion;

a second filtering portion provided on an output path for the received signal from the left-hand frequency changing portion, for passing of the received signal from the left-hand frequency changing portion as well as for eliminating at least signal components within frequency bands lower than of the received signal from the left-hand frequency changing portion; and a received signals output portion for mixing the received signals from the right-hand frequency changing portion passed through the first filtering portion and the received signal from the left-hand frequency changing portion passed through the second filtering portion, thereby outputting the received signals at a common output-terminal.

9. A converter for an antenna to facilitate receiving a right-hand circularly polarized radio wave of a first frequency band from a first artificial satellite, a right-hand circularly polarized radio wave of a second frequency band from a second artificial satellite and a left-hand circularly polarized radio wave within the second frequency band to be transmitted from the second artificial satellite signals, the converter comprising:

right-hand frequency changing portion, including a first oscillator for generating firs oscillating signals, for changing frequencies only of the received signals of the right-hand circularly polarized radio waves within the first and second frequency bands to convert the received right-hand circularly polarized radio waves, via use of the first oscillating signals, into received signals within the respectively predetermined transmission frequency bands;

a left-hand frequency changing portion, including a second oscillator for generating second oscillating signal having an oscillation frequency lower than the first oscillating signals, for changing a frequency of only the received signal of the left-hand circularly polarized radio wave within the second frequency band to convert the received left-hand circularly polarized radio wave, via use of the second oscillating signal, into a received signal within a transmission frequency band with frequencies higher than the frequencies of the received signals outputted from the right-hand frequency changing portion;

first filtering portion, provided along an output path for the received signals from the right-hand frequency changing portion, for passing only the received signals from tie right-hand frequency changing portion and for eliminating at least signal components within a frequency band similar to the received signal outputted from the left-hand frequency changing portion;

a second filtering portion, provided along an output path for the received signal from the left-hand frequency changing portion, for passing only the received signal from the and frequency changing portion and for eliminating at least signal components within frequency bands similar the received signals outputted from the right-hand frequency changing portion; and a received signals output portion for mixing the received signals from the right-hand frequency changing portion, passed through the first filtering portion, and the received signal from the left-hand frequency changing portion, passed through the second filtering portion, to thereby output the received signals at a common output-terminal.

10. The converter for an antenna for receiving signals from two satellites according to claim 9, wherein the antenna further comprises:

a reflector for reflecting received signals from the first and second artificial satellites toward a signal receiving portion located at a focal point of the reflector, and the signal receiving portion being supported at the focal point of the reflector via a supporting arm;

the right-hand frequency changing portion comprises:

a first right-hand frequency amplifying circuit for amplifying a received right-hand frequency signal;

a right-hand frequency mixer electrically connected to the first right-hand frequency amplifying circuit and to the first oscillator for mixing the first oscillating signal with thy signal received from the first right-hand frequency amplifying circuit;

a second right-hand frequency amplifying circuit for receiving the signal mixed boy the right-hand frequency mixer and for supplying an amplified signal to the first filtering portion; and the left-hand frequency changing portion comprises:

a first left-hand frequency amplifying circuit for amplifying a received left-sand frequency signal;

a left-hand frequency mixer electrically connected to the first left-hand frequency amplifying circuit and to the second oscillator for mixing the second oscillating signal with the signal received from the first left-hand frequency amplifying circuit;

a second left-hand frequency amplifying circuit for receiving the signal mixed by the left frequency mixer and for supplying an amplified signal to the second filtering portion; and the converter further comprises a combined mixing device for mixing a signal receive from the first filtering portion with a signal received from the second filtering portion and outputting the combined mixed signal to a power source separating filter, and the power source separating filter is electrically connected to the common output-terminal.

11. The converter for an antenna for receiving signals from two satellites according to claim 10, wherein:

the first frequency band is between 11.713 and 12.013 GHz; and the second frequency band is between 12.271 and 12.751 GHz.

* * * * *